US006652253B1

(12) United States Patent
Crafton et al.

(10) Patent No.: US 6,652,253 B1
(45) Date of Patent: Nov. 25, 2003

(54) HYDRAULIC PUMP HAVING A NOISE REDUCTION RECESS

(75) Inventors: Drew A. Crafton, Mooresville, IN (US); Gregory W. Kempf, Avon, IN (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/195,841

(22) Filed: Jul. 15, 2002

(51) Int. Cl.[7] ..... F04C 2/10
(52) U.S. Cl. ..... 418/170; 418/189
(58) Field of Search ..... 418/166, 170, 418/171, 189

(56) References Cited

U.S. PATENT DOCUMENTS 4,767,296 A * 8/1988 Satomoto et al. ..... 418/171
4,897,025 A * 1/1990 Negishi ..... 418/189
6,089,841 A * 7/2000 Meernik et al. ..... 418/189

* cited by examiner

*Primary Examiner*—John J. Vrablik
(74) *Attorney, Agent, or Firm*—Leslie C. Hodges

(57) ABSTRACT

An internal/external gear pump includes a wear plate disposed between the gear members and at least one sidewall of the pump. The wear plate has a recess formed therein having a substantially constant depth and width. The recess extends into the full mesh point between the gear members of the pump to provide a flow path from the full mesh point to an inlet side or suction port of the pump.

3 Claims, 2 Drawing Sheets

HYDRAULIC PUMP HAVING A NOISE REDUCTION RECESS

TECHNICAL FIELD

This invention relates to positive displacement hydraulic pumps and, more particularly, to internal/external gear pumps.

BACKGROUND OF THE INVENTION

Internal/external gear pumps (IX pumps) have an internally toothed gear and an externally toothed gear, which are rotatably mounted in a housing. The externally toothed gear is usually the drive gear, and the internally toothed gear is usually the driven gear. These two gear members have offset rotatable axes and therefore have a single mesh point, which is opposite the maximum offset. When the two gear members are exiting the mesh points, the gear teeth remain engaged for approximately three or four teeth and then separate or are separating during that engagement and create a space between the rotating gear members which is filled with fluid such as hydraulic fluid from a reservoir through a suction port.

The rotation of the gears take the internal/external gears past a crescent or divider which separates the internally toothed member from the externally toothed member and seals flow trapped within the tooth spaces from returning to the inlet port. As the rotation continues, the toothed gear members are directed to come back into mesh, and as the space between the toothed gear members decreases, the fluid found therein is forced to exit through a pressure port. The gear members then, during this fluid exiting procedure, come back into mesh and start about three or four teeth before the full mesh point. There is one full mesh point during the gear rotation. At the full mesh point, the pump body and wear plate form a dam area.

This mesh point, along with the dam area in the body and wear plate, generally forms a boundary between the higher pressure fluid in the discharge port and the low pressure fluid in the intake port. As this mesh point passes across the dam, increasingly more area of the gears is exposed to high pressure building the forces exerted on the gears. The transition of the mesh point into the suction port exhausts the area previously exposed to high pressure, thus generating a force change on the gears which can result in transmission noise that is disturbing to the operator.

Internal/external pumps in the prior art have been known to employ metering grooves for both the inlet port and the discharge port. These metering grooves, however, cannot overlap within the full mesh point without creating excess leakage, which reduces the performance of the pump at its function of fluid transfer. Thus, this noise phenomenon can still occur within IX pumps. In certain environments, noise created by this event can be of concern to the operator. While those skilled in the art know that there is no performance problem, just a slight noise generation, it has still been a desire to eliminate the noise if at all possible.

It is also well known that those skilled in the art find the implementation of noise-reducing grooves difficult to manufacture. These grooves are of a graduated depth, that is, they are very narrow at the outermost point of their depth and they increase in depth as they approach the port with which they intercept. During manufacturing, it is difficult to control the dimensions of the depth and thus they are costly to produce within the pump body.

SUMMARY OF THE INVENTION

It is an object of the present invention to provide an improved internal/external gear pump having a noise control recess.

In one aspect of the present invention, the full mesh point of the IX pump is intercepted by a recess, which is communicated with the inlet port of the IX pump.

In another aspect of the present invention, the recess is positioned in a wear plate, which is disposed within a pump housing.

In yet another aspect of the present invention, the wear plate is sufficiently large to encompass the maximum portion of the pump housing covering both the internal/external gears as well as a portion of the outer flange of the housing.

In still another aspect of the present invention, the full mesh point is a dam area, which prevents fluid communication between the pressure port and the suction port.

In yet still another aspect of the present invention, the recess intersects the dam area at a location wherein the fluid communication is only between the dam area and the suction port.

In a further aspect of the present invention, the noise recess has a substantially constant width and depth.

DESCRIPTION OF AN EXEMPLARY EMBODIMENT

Figure 1:
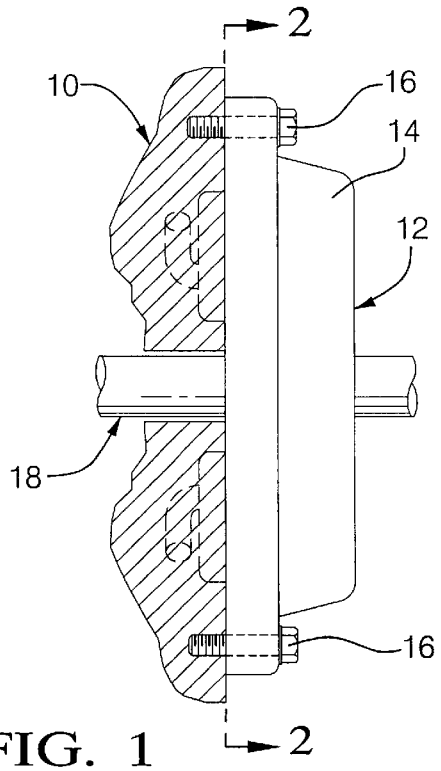
FIG. 1 is an elevational view partly in section of a portion of a transmission mechanism having a hydraulic control pump.

Referring to the drawings, wherein like characters represent the same or corresponding parts throughout the several views, there is seen in FIG. 1 a transmission housing 10 to which is secured a pump 12. The pump 12 has a body or housing 14, which is secured to the housing 10 by a plurality of fasteners 16. The transmission housing 10 also rotatably supports a shaft member 18, which passes through the housing 10 and also through the housing 14 of the pump 12.

Figure 2:
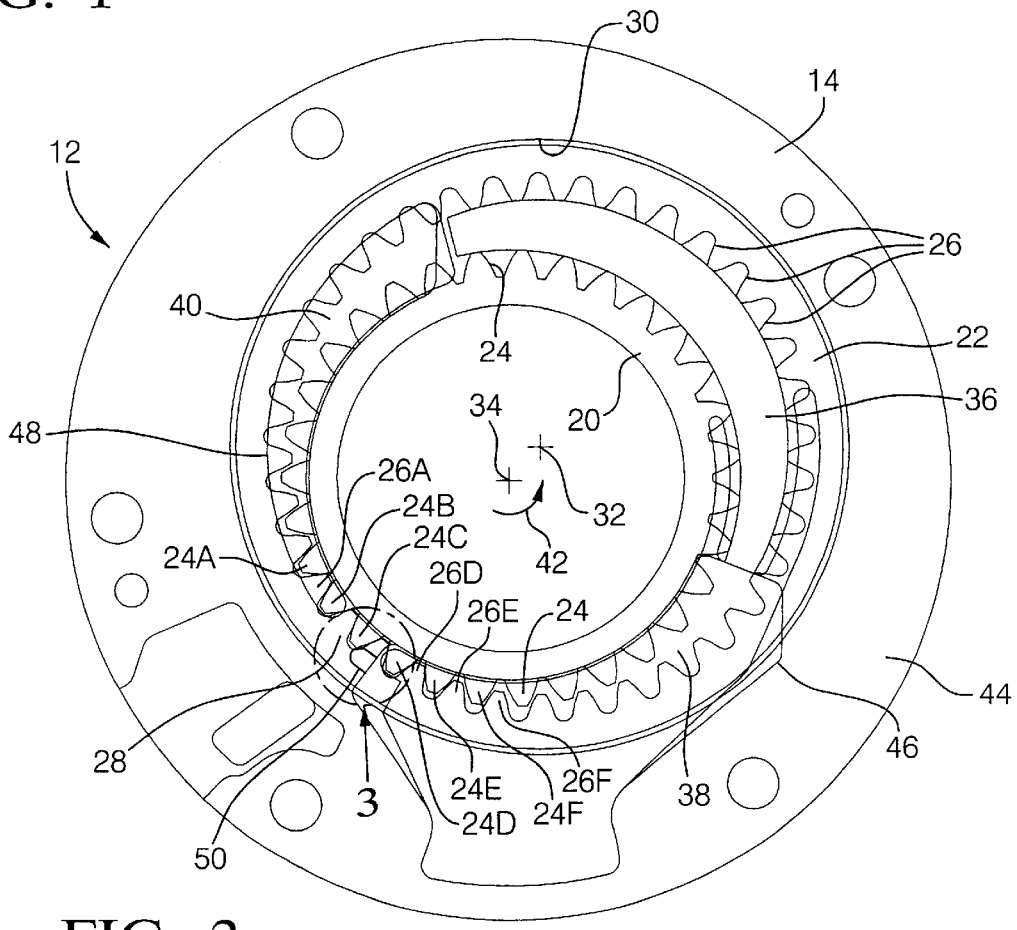
FIG. 2 is view taken along line 2—2 of FIG. 1 showing the internal components of the pump shown in FIG. 1 and incorporating the present invention.

As seen in FIG. 2, the pump 12 includes an externally toothed gear member 20 and an internally toothed gear member 22. The gear member 20 has a plurality of teeth 24 formed on the outer periphery thereof, and the gear member 22 has a plurality of teeth 26 formed on the internal periphery thereof. The gear member 20 is rotatably connected with the shaft 18 such that when the shaft 18 rotates, the gear 20 also rotates. The gear 20 has a plurality of teeth 24A through 24F that are disposed in meshing relationship with teeth 26A through 26F. The tooth 24C is fully engaged between the teeth 26B and 26C within a dam area 28.

The gear 22 is rotatably supported in a recess 30 formed in the housing 14. The gear 22 rotates about an axis 32, which is offset from an axis 34 of the gear 20 and the shaft 18. This offset is most noticeable at each position opposite the dam area 28. The separation of the two gears is filled at least partially by a crescent member 36, which is generally ensuing engagement with the teeth 24 of the gear 20 and the teeth 26 of the gear 22.

As can be seen in FIG. 2, the teeth 24 separate from teeth 26 in an area 38, and these teeth are also separated in an area 40. The dam area 28 separates these areas 38 and 40 on one side and the crescent member 36 separates these areas 38 and 40 on the opposite side. The area 38 is an inlet or suction port area, and the area 40 is a discharge or pressure port. These ports are defined by the rotational direction of the gear 20, which is in the direction of arrow 42.

As the externally toothed gear 20 operates in the direction of arrow 42, the internally toothed gear 22 is driven thereby. As seen in FIG. 2, these separate from the suction port 38 such that fluid is drawn from a reservoir, not shown, into the suction port 38 to fill the space between the teeth 24 and 26. As the gear continues to rotate and the gear members reach the pressure port 40, the teeth are coming into mesh such that the fluid found in this area is discharged from the pump to be supplied to a pressure control and other elements for a transmission. As the pump enters the dam area 28, the teeth 24 and 26 come into a more complete meshing engagement such that in the dam area the tooth 24C is fully engaged in the teeth 26B and 26C leaving a minimum clearance at the tips of the teeth.

The pump 12 has a wear plate 44 disposed between the transmission housing 10 and the gears 20 and 22 as well as the housing 14. The wear plate 44 has an opening 46 for the inlet or suction port 38 and an opening 48 for the discharge or pressure port 40. The wear plate 44 also has a recess 50, which is interconnected with the suction port opening 46.

Figure 4:
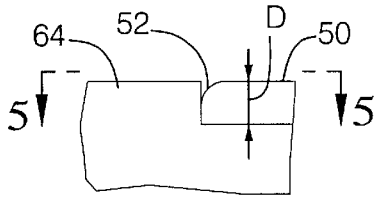
FIG. 4 is a view taken along line 4—4 of FIG. 3.
Figure 5:
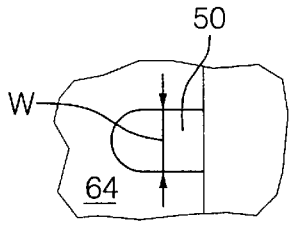
FIG. 5 is a view taken along line 5—5 of FIG. 4.

As best seen in FIGS. 4 and 5, the recess 50 has a substantially constant width W and a substantially constant depth D. The recess 50 does have a rounded end 52, which is in place for ease of manufacturing. As seen in FIG. 2 , the recess 50 extends substantially halfway through the mesh point in the dam area 28 between the gear tooth 24C and the gear teeth 26D and 26C.

Figure 3:
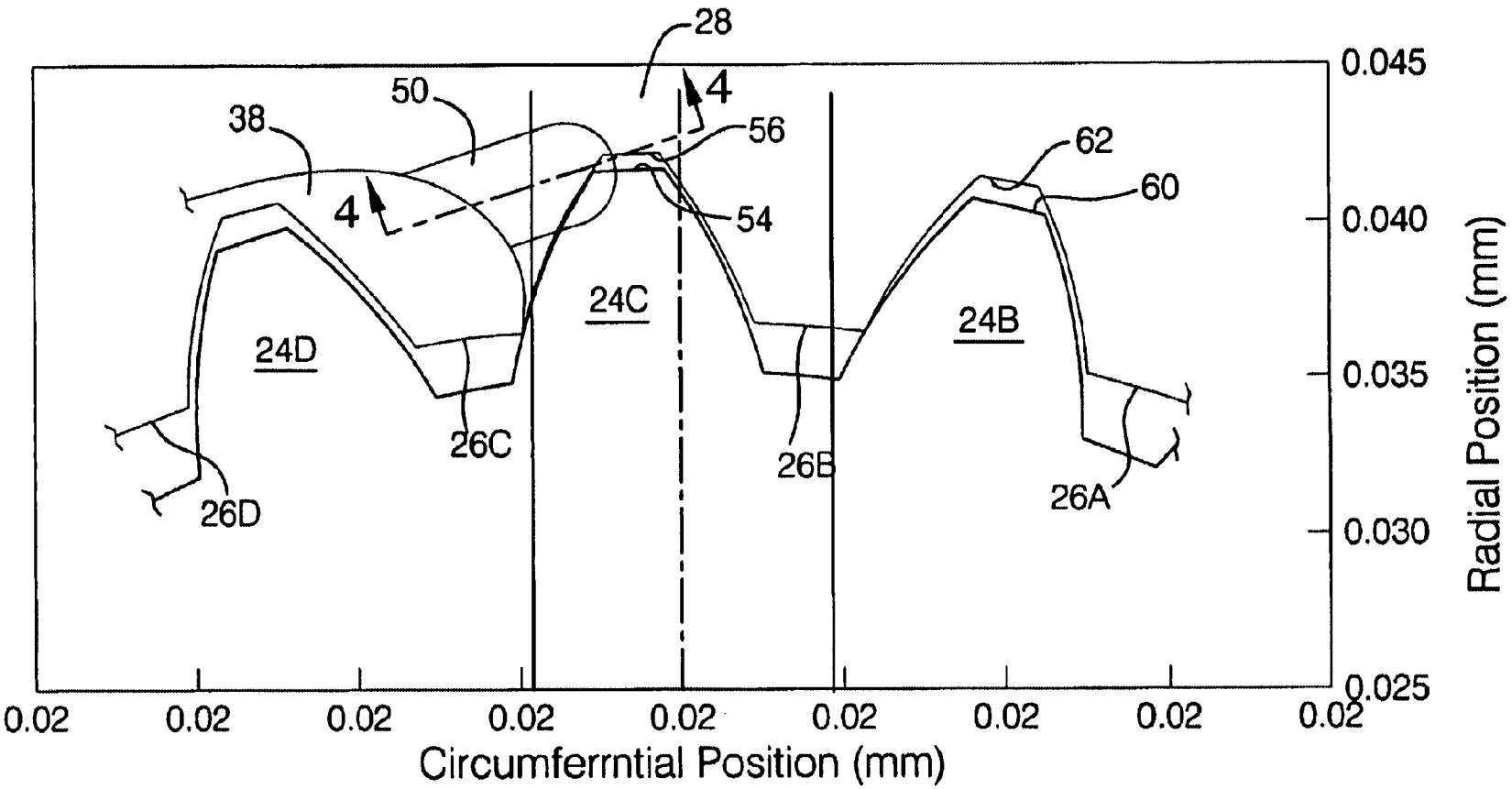
FIG. 3 is an enlarged view of the area of the pump shown in the circle 3 of FIG. 2.

Those skilled in the art will recognize that any fluid trapped between the teeth 24C and 26B and 26C will be communicated with the recess 50. This is best seen in the enlarged view of FIG. 3. As the gears come into full mesh, the fluid trapped between the outer periphery 54 of the gear teeth 24C and an inner periphery 56 of a space between gear teeth 26B and 26C will be compressed by this meshing engagement. Without the deployment of the recess 50, the pressure in the fluid will become extremely high creating separating forces on the gears 20 and 22. These forces would, of course, be employed by the bearings on which these gear members are supported. However, this increased pressure can produce a noise due to the increased engagement force.

Noise is also produced when the gear teeth begin to separate as shown with the engagement between the tooth 24D and the space between the teeth 26C and 26D. When this occurs, the fluid is rapidly expanded into the inlet port 38, again producing noise. The recess 50 intercepts this fluid between the peripheries 54 and 56 to prevent the increased pressure and simultaneously port the fluid to the inlet port 38. This prevents the high-pressure generation and thereby eliminates the noise associated therewith.

The gear teeth 24B, 26B, and 26A prevent excess fluid from the pressure port 40 from flowing into the inlet port 38. It will also be noted that there are other gear teeth besides 26A and 26B which cooperate to prevent this backflow of fluid. Those skilled in the art will recognize if the mesh engagement between tooth 24C and tooth 26C progresses in the direction of rotation, the next set of meshing teeth 24B, 26B, and 26A will rotate into full mesh at the dam area 28, thereby providing a fluid connection between the recess 50 and an outer periphery 60 of tooth 24B and an outer periphery 62 and the tooth space between the gear teeth 26A and 26B. Thus, the entering of meshing teeth into the dam area will continually revolve as the pump is operated.

While the pump is shown as having a single wear plate disposed between the transmission housing 10 and the pump housing 14, it is also possible to put a wear plate within the cavity in the housing 14 in which the gears 20 and 22 are disposed therebetween and providing a recess on both sides of the dam area, which can improve the efficiency of the fluid flow between the meshing teeth.

The recess 50 is formed below a face 64 of the wear plate 44. The recess 50, as seen in FIGS. 4 and 5, has a constant width W and depth D which provide for simplicity and consistency in manufacture. The wear plate 44 is a thin member permitting the recess 50 to be formed in the face 64 by a coining or stamping process, which are well-known simple manufacturing expedients.

Obviously, modifications and variations are possible in light of the above disclosure. Therefore, it should be understood that the invention is only to be limited by the scope of the appended claims.

What is claimed is:

1. An internal/external gear pump comprising:

an externally toothed gear member;

an internally toothed gear member;

an inlet port admitting fluid to said pump;

an outlet port discharging fluid from said pump at an elevated pressure;

said toothed gear members having a mesh area wherein the external and internal teeth enter into and retract from an intermeshing relationship, said internally toothed gear member and said externally toothed gear member having a full mesh position between said inlet port and said outlet port within the mesh area wherein one tooth of the externally toothed member is fully meshed in a space between two teeth of said internally toothed gear member defining a volume of trapped fluid;

one side of said full mesh position axially defining an inlet portion of said pump and another side of said full mesh position defining a pressure portion of said pump;

a sidewall disposed adjacent said gear members defining one closure wall for said pump; and a recess formed in said sidewall extending from said inlet port to a leading edge of said trapped volume in said full mesh position to establish a restricted flow path between said volume of trapped fluid and said inlet port.

2. The internal/external gear pump defined in claim 1 further comprising:

said recess having a substantially constant depth and a substantially constant width.

3. The internal/external gear pump defined in claim 2 further wherein each tooth of said externally toothed gear member has an outer periphery that comes in close proximity to an outer periphery between adjacent teeth of said internally toothed gear member to form a closed chamber, within the mesh area, to both said input port and said output port and said closed chamber being vented to said inlet port by said recess.

* * * * *